United States Patent [19]

Schulz

[11] Patent Number: 4,623,767

[45] Date of Patent: Nov. 18, 1986

[54] DISCONNECT SWITCH FOR METAL-CLAD, PRESSURIZED GAS-INSULATED HIGH-VOLTAGE SWITCHGEAR WITH DAMPING RESISTORS

[75] Inventor: Winfried Schulz, Berlin, Fed. Rep. of Germany

[73] Assignee: Siemens Aktiengesellschaft, Munich and Berlin, Fed. Rep. of Germany

[21] Appl. No.: 700,540

[22] Filed: Feb. 11, 1985

[30] Foreign Application Priority Data

Feb. 16, 1984 [DE] Fed. Rep. of Germany ..... 3405850

[51] Int. Cl.[4] ..... H01H 33/16

[52] U.S. Cl. ..... 200/144 AP; 200/148 D; 338/292; 338/293

[58] Field of Search ..... 200/144 AP; 338/292, 338/293, 288, 290

[56] References Cited

U.S. PATENT DOCUMENTS

| | | | |
|---|---|---|---|
| 3,829,707 | 8/1974 | Pflanz | 307/147 |
| 3,858,147 | 12/1974 | Caddock | 338/292 |
| 4,539,448 | 9/1985 | Schulz | 200/144 AP |

FOREIGN PATENT DOCUMENTS

| | | | |
|---|---|---|---|
| 2406160 | 8/1974 | Fed. Rep. of Germany . | |
| 3216275 | 9/1983 | Fed. Rep. of Germany . | |
| 672519 | 5/1952 | United Kingdom | 338/293 |
| 1314388 | 4/1973 | United Kingdom | 388/292 |

*Primary Examiner*—Robert S. Macon

*Attorney, Agent, or Firm*—F. W. Powers; J. L. James

[57] ABSTRACT

A disconnect switch for metal-enclosed, compressed gas-insulated high-voltage switchgear, having two resistors for the suppression of high-frequency oscillations caused by the occurrence of a pre-flashover arc, each located along the longitudinal axis of and electrically connected to a moveable rod. Furthermore, a movable insulating tube covers the disconnect gap substantially before the resistors make or break contact with each other. Each resistor is comprised of several resistive elements which lie adjacent to one another between two contact plates at each end and are molded of hardened cast resin. Each element is comprised of a ceramic plate with baked-on strips of resistive material which have contacts on all four edges.

12 Claims, 4 Drawing Figures

DISCONNECT SWITCH FOR METAL-CLAD, PRESSURIZED GAS-INSULATED HIGH-VOLTAGE SWITCHGEAR WITH DAMPING RESISTORSCL CROSS-REFERENCE TO RELATED APPLICATIONS

This application is related to co-pending application: "Disconnect Switch for Metal-Clad, Pressurized-Gas Insulated, High-Voltage Switchgear Installation", U.S. Patent Office Ser. No. 646,434 W. Schulz, dated Aug. 30, 1984.

BACKGROUND OF THE INVENTION

This invention relates to the field of metal clad, compressed-gas-insulated high-voltage switchgear and more particularly to resistors for use with such a disconnect switch, that prevent flashover through arc suppression and damping.

When switching a disconnect switch, pre-flashover arcs occur, creating wide band high frequency oscillations. Within enclosed high-voltage switchgear, some of the frequencies of said wide band high frequency oscillations can, under certain circumstances, be naturally electrically resonant as a result of the physical dimensions of the enclosed high-voltage switchgear, thereby producing standing waves through internal reflections within the enclosed high-voltage switchgear. During standing wave conditions, local current peaks can reach such am amplitude that the flashover resistance is reduced to the extent that, at the location of a standing wave current peak, a flashover to the metal enclosure can occur.

One method of preventing the propagation of high frequency oscillations is to use low conductivity, high permeability coatings as shown in U.S. Pat. No. 3,829,707 dated Aug. 13, 1974 and in F.R.G. Offenlegungschrift DE No. 3,216,275 dated Sept. 29, 1983. The low conductivity and high permeability of the coating present a high impedance to dampen high frequency oscillations.

The problem with using metallic coatings as a high frequency oscillation suppressor is two-fold. First, since the number and cross-sectional area of the arcs drawn are not controllable, the resistance of the resistive coating presented during operation varies greatly. Second, since arcs and their chemical by-products in an SF6 atmosphere can and do erode metallic surfaces, the effectiveness as a high frequency suppressant of an iron coating will degrade with use.

The problem of using a lumped resistor instead of a distributed resistive coating is the power dissipation requirements of such a lumped resistor during switching.

It is an object of this invention to provide a resistor fo application in pressurized gas-insulated high voltage switchgear. Another object of this invention is to provide a consistent high resistance to high frequency oscillations as encountered in pre-flashover arcs in high-voltage metal-clad switchgear disconnect switches. A further object of this invention is to provide a resistor having high thermal conductivity suitable for use in high-voltage switchgear disconnect switches.

SUMMARY OF THE INVENTION

Briefly stated, in accordance with one aspect of the invention, the foregoing objects are achieved by having a disconnect switch for metal-clad, pressurized gas-insulated high-voltage switchgear with two field electrodes located on each side of the disconnect gap and at least one contact electrode slideably disposed within and in electrical contact with one of the field electrodes, with a maximum of one contact electrode associated with each field electrode, and a moveable insulating tube almost bridging the disconnect gap during the process of a switching action. Also during the process of a switching action, two moveable rods move inside the insulating tube as it is in the almost bridging position of the disconnect gap. Located along the longitudinal axis of and in electrically connected or connectable to each one of the moveable rods in a moveable resistor. Each resistor has a thermally highly-conductive ceramic carrier with outer dimensions smaller than the inside diameter of the insulating tube. The resistors are located in the disconnect gap at the outset of a switching action, bridging the gap after the disposition of the insulating tube into its almost bridging position during opening or closing of the connection between the field electrodes. Each resistor has a plurality of elements spaced from each other and located between two metallic contact plates disposed on each end. Each element is comprised of a ceramic plate having resistive material strips baked on one side thereof. The elements being physically and electrically connected between two contact plates and moulded into a resistor out of hardened cast resin between the contact plates.

In another aspect of the invention the resistive material strips are baked on both sides of the ceramic plate.

BRIEF DESCRIPTION OF THE DRAWINGS

While the specification concludes with claims particularly pointing out and distinctly claiming the subject matter which is regarded as the invention, it is believed that the invention will be better understood from the following description of the preferred embodiment taken in conjunction with the accompanying drawings in which:

DETAILED DESCRIPTION OF THE DRAWINGS

Figure 1:
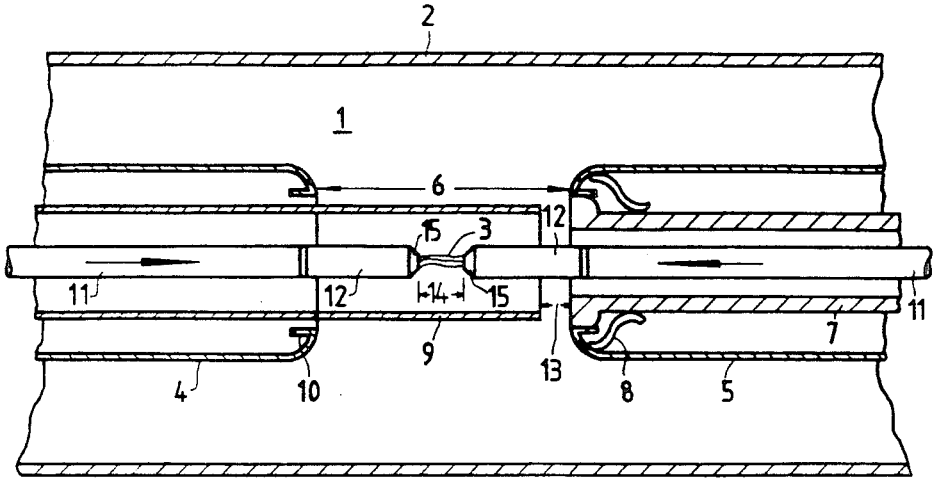
FIG. 1 is a diagrammatic view of a longitudinal section view of a disconnect switch having damping resistors.

A metal-enclosed high-voltage switchgear unit insulated with compressed gas, e.g., SF6, contains a disconnect switch 1 inside a metallically grounded enclosure 2. It is shown in FIG. 1 in a switching position during which the pre-flashover arc 3 occurs. The disconnect switch 1 has two opposing coaxial, cylindrical field electrodes 4 and 5 disposed on a common longitudinal axis, between which lies the disconnect gap 6 indicated by arrows, which is open when the disconnect switch 1 is in the off position. Inside the right-hand field electrode 5 is a movable contact electrode 7 in the form of a contact tube which is located on the same longitudinal axis and is electrically connected with the field electrode 5 by means of a sliding contact 8 and thus is at the same potential as the latter.

Inside the stationary field electrode 4 on the left on the same axis is a movable insulating tube 9, whose outer diameter is smaller than the diameter of the edge 10 of the opening of the field electrode 4. Furthermore, along the longitudinal axis of the field electrodes 4, 5 lie two central conductive movable rods 11, on whose ends facing the disconnect gap 6 are mounted two cylindrical resistors 12. A conductive connection exists between the field electrodes 4, 5, respectively, and said rods 11 and the resistors 12, so that the resistors 12 have the potential of the field electrodes 4, 5 also.

When the disconnect switch 1 is in the off position, the resistors 12, the insulating tube 9, and the movable contact electrode 7 all reside within the field electrodes 4, 5 and thus do not protrude into the disconnect gap 6. The electrical field within the disconnect gap 6 thus depends upon the form of the field electrodes 4, 5 and is not disturbed by the parts within them.

At the outset of the switching-on motion, only the insulating tube 9, with the help of a not depicted drive, is moved from the field electrode 4 into the disconnect gap until it reaches a final position at the distance 13, as indicated by the arrows, from the opposite field electrode 5. Said distance 13 is dimensioned sufficiently large so as to insure that no surface discharge occurs on the surface of the insulating tube 9.

Thereafter, with the help of the driven moveable rods 11, the two resistors 12 are brought out symmetrically from both sides into the disconnect gap 6. Thus, the disconnect gap 14 remaining between their end surfaces always lies in the center of the disconnect gap 6. If this remaining disconnect gap 14 has become sufficiently small, the pre-flashover arc 3 occurs between the two resistors 12. A drifting of the pre-flashover arc 3 onto the metal enclosure 2 is not possible because of the shield provided by the insulating tube 9. The symmetrical dampening provided by the resistors 12 during ignition or reignition of the pre-flashover arc 3 prevents the occurrence of high-frequency oscillations or dampens them significantly.

Once the two resistors 12, as the switching motion continues, touch ends with their metallic contact plates 15, the movable contact electrode 7 is brought into contact with the field electrode 4, with the insulating tube 9 being withdrawn again. With the disconnect switch 1 in closed position, the operating current thus flows from the field electrode 4 via the movable contact electrode 7 to the field electrode 5 so that the heating effect of the current can dissipate to the outside unobstructed. When opening disconnect switch 1, the motions of the individual parts occur in the reverse order so that the often reigniting pre-flashover arcs once again lie in between the resistors 12 as they slowly move apart.

Figure 2:
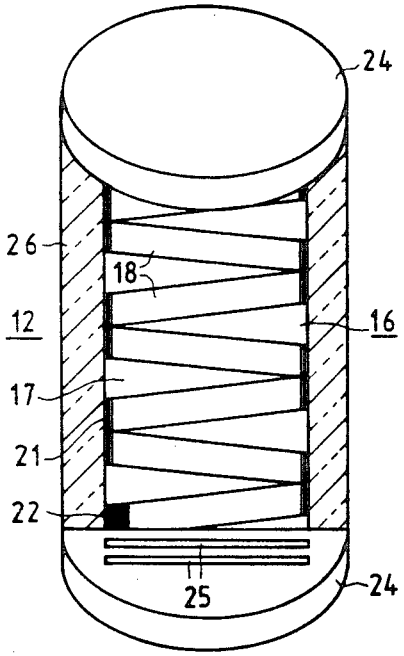
FIG. 2 is a diagrammatic, longitudinal cross-sectional view of resistor in FIG. 1.
Figures 3, 4:
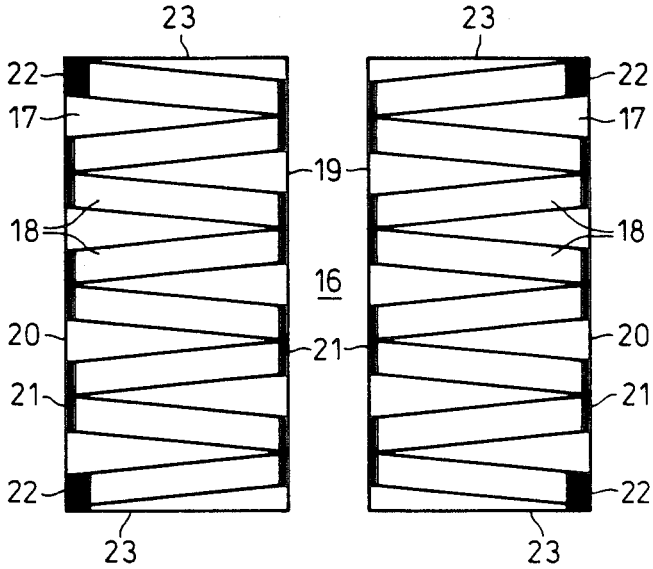
FIG. 3 is a front plan view of one of the resistor elements.
FIG. 4 is a rear plan view of the resistor element shown in FIG. 3.

The configuration of the resistor 12 can be seen in FIGS. 2 and 3. Each resistor 12 is comprised of several elements 16. Each element 16 consists of a rectangular plate 17 of a good or high thermally conductive ceramic material and strips 18 of resistance material in paste form are baked onto one surface in one embodiment, and two surfaces in a second embodiment. The baked-on strips 18 run in a zig-zag fashion from one edge 19 of the plate to its opposite edge 20. As the strips 18 are congruent on both surfaces of plate 17 in the two-sided element embodiment, they are connected with each other by a metal contact 21 in those locations where they meet at edges 19, 20, thus always being connected in parallel. In the one-sided embodiment the end of strips 18 are connected in series by a metal contact 21. At the beginning and at the end of the strips 18 another metal contact 22 having a larger surface exists which extends to each frontal edge 23 at the top and bottom of plate 17.

Several elements 16 are arranged next to one another spaced apart between two metallic contact plates 24 made of copper at each end. For this purpose, the contact plates 24 are provided with parallel slits 25 on one side, into which the frontal edges 23 of plates 17 fit, to permit an electrical contact between the metal contacts 22 at the ends of strips 18 and contact plates 24. Thus, all elements 16 are also connected in parallel. The entire assembly is then moulded in hardened cast resin 16, e.g., epoxy resin, such that the resistor 12 forms a cylinder. In thus doing, both outer surfaces of the contact plates are left exposed for making electrical contact between the rods 11 and the resistors 12 and for making electrical contact with metallic contact plates 15.

It will not be understood that the present invention has one or more contact electrodes, field electrodes, moveable rods and a movable insulating tube. The tube is disposed between the field electrodes and substantially bridges the disconnecting and isolating gap between the field electrodes as long as the one or more contact electrodes are in the switching process of opening or closing. The purpose of this insulating tube is to contain an arc between the moveable rods especially used for arc management during switching from drifting to the metal housing and thereby causing a short circuit flashover. Further, the present invention has two moveable resistors of approximately the same size, both physically and electrically, each arranged along the longitudinal axis of and, in electrical contact with, a different moveable rod. The resistors, because they are electrically in series with any high frequency oscillations generated by the pre-flashover arcs, dissipate and dampen such oscillations thereby preventing flashovers induced by high frequency standing wave current peaks. Such resistors must have high electrical resistance and low thermal resistance in the presence of high-voltage pre-flashover arcs to dissipate energy to the moveable rods and through outside surfaces to pressurized gas.

As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true spirit and script of the invention.

What is claimed as new and desired to be secured by Letters Patent of the United States is:

1. A disconnect switch for metal-enclosed, pressurized gas-insulated high-voltage switchgear having two field electrodes disposed on opposite sides of the disconnect gap; moveable cylindrical contact electrode slidably disposed within and in electrical contact with one of the field electrodes; a moveable insulating tube arranged with one other field electrode substantially bridging the disconnect gap between the field electrodes during a switching action; two moveable rods, each being electrically connected to a different field electrode, moving inside the insulating tube during switching actions; and two moveable resistors of approximately the same size, located along the longitudinal axis of and each electrically connectable respectively to one of the moveable rods, said moveable resistors having a thermally highly-conductive ceramic carrier and have outer dimensions smaller than the inner diameter of the insulating tube, and are inserted into the disconnect gap at the outset of the switching action, bridging the gap before the contact electrode bridges the disconnect gap between the field electrodes, characterized by each of the two moveable resistors comprising: at least one element located between a top and bottom metallic contact plate at each end thereof, and each said element including a ceramic plate bearing baked-on strips of resistance material which are terminated at the top and bottom edges of said ceramic plate; each edge facing and electrically contacting one of said top and bottom metallic plates, and by each of the two moveable resistors being molded together with hardened cast resin such that said contact plates can be electrically contacted from an outer surface.

2. A disconnect switch according to claim 1, wherein said baked on strips are arranged in a zig-zag configuration on at least one side of said ceramic plates.

3. A disconnect switch according to claim 2, wherein said strips are congruently arranged on both sides of said plates and wherein the front and backside strips are metallically connected along each location where terminated at a common edge.

4. A disconnect switch according to claim 1, wherein said top and bottom metallic contact plates are provided with at least one slit on an inner surface for accommodating the plates.

5. A disconnect switch according to claim 4, further comprising said metallic contact plates being made out of copper.

6. A disconnect switch according to claim 1, wherein said resistor is cylindrically shaped.

7. A disconnect switch for metal-enclosed, pressurized gas-insulated high-voltage switchgear having two cylindrical field electrodes disposed on a common longitudinal axis on opposite sides of the disconnect gap; a moveable cylindrical contact electrode slidably disposed on the same axis within and in electrical contact with one of the field electrodes; a moveable insulating tube arranged within the other field electrode substantially bridging in its final position the disconnect gap between the field electrodes during a switching action; two central moveable rods, each being electrically connected to a different field electrode, moving inside the insulating tube during switching actions; and two moveable resistors of approximately the same size, located along the longitudinal axis and each electrically connectable respectively to one of the moveable rods, said moveable resistors have a good thermally conductive ceramic carrier and have outer dimensions smaller than the inner diameter of the insulating tube, and are inserted into the disconnect gap at the outset of the switching action, bridging the gap after the insulating tube has reached its final position before the contact electrode bridges the disconnect gap between the field electrodes, characterized by each of the two moveable resistors comprising: at least two elements located between a top and bottom metallic contact plate at each end thereof, and each said element including a ceramic plate bearing baked-on strips of resistance material which are terminated at the top and bottom edges of said ceramic plate, each edge facing and electrically contacting one of said top and bottom metallic plates, and by each of the two moveable resistors being molded together with hardened cast resin such that said contact plates can be electrically contacted from an outer surface.

8. A disconnect switch according to claim 7, wherein said baked on strips are arranged in a zig-zag configuration on at least one side of said ceramic plates.

9. A disconnect switch according to claim 8, wherein said strips are congruently arranged on both sides of said plates and wherein the front and backside strips are metallically connected along each location where terminated at a common edge.

10. A disconnect switch according to claim 7, wherein said top and bottom metallic contact plates are provided with at least one slit on an inner surface for accommodating the plates.

11. A disconnect switch according to claim 10, further comprising said metallic contact plates being made out of copper.

12. A disconnect switch according to claim 7, wherein said resistor is cylindrically shaped.

* * * * *